US005838280A

United States Patent [19]

Miyashita

[11] Patent Number: 5,838,280

[45] Date of Patent: Nov. 17, 1998

[54] MICROSTRIP TYPE ANTENNA HAVING SMALL SIZE AND CAPABLE OF CHANGING GAIN

[75] Inventor: Toshikazu Miyashita, Tokyo, Japan

[73] Assignee: NEC Corporation, Tokyo, Japan

[21] Appl. No.: 753,899

[22] Filed: Dec. 2, 1996

[30] Foreign Application Priority Data

Dec. 1, 1995 [JP] Japan ..... 7-313886

[51] Int. Cl.[6] ..... H01Q 3/02; H01Q 1/24; H01Q 1/48

[52] U.S. Cl. ..... 343/700 MS; 343/702; 343/846

[58] Field of Search ..... 343/700 MS, 702, 343/846

[56] References Cited

U.S. PATENT DOCUMENTS

| | | | |
|---|---|---|---|
| 2,491,629 | 12/1949 | Vervier et al. | 343/901 |
| 4,495,503 | 1/1985 | Morman | 343/746 |
| 4,725,845 | 2/1988 | Phillips | 343/702 |
| 4,829,591 | 5/1989 | Hashimoto et al. | 455/89 |
| 4,924,237 | 5/1990 | Honda et al. | 343/702 |
| 5,245,349 | 9/1993 | Harada | 343/700 MS |
| 5,255,001 | 10/1993 | Tamura et al. | 343/702 |
| 5,689,821 | 11/1997 | Shimazaki | 455/89 |
| 5,696,372 | 12/1997 | Grober et al. | 343/795 |

FOREIGN PATENT DOCUMENTS

| | | | |
|---|---|---|---|
| 0 272 752 A2 | 6/1988 | European Pat. Off. . | |
| 0 684 661 A1 | 11/1995 | European Pat. Off. . | |
| 41 30 493 A1 | 3/1993 | Germany . | |
| 2-79602 | 3/1990 | Japan | H01Q 13/08 |

OTHER PUBLICATIONS

Patent Abstract of Japan, vol. 5, No. 55 no date.

Dahele et al., "Theory and experiment on microstrip antennas with airgaps", 1985, *IEEE Proceedings H Microwaves, Antennas & Propagation,* pp. 455–460.

*Primary Examiner*—Anita Pellman Gross
*Assistant Examiner*—Daniel St. Cyr
*Attorney, Agent, or Firm*—Scully, Scott, Murphy & Presser

[57] ABSTRACT

In a microstrip type antenna used in a radio transceiver, the microstrip type antenna comprises a push-button switch which has a locked state of a first height and an unlocked state of a second height being taller than the first height. The locked state and the unlocked state are changed alternately whenever the push-button switch is pushed down. A dielectric plate is connected to the push-button switch and has first and second surfaces which are parallel to each other. A plane antenna element has a principal part which is located in parallel with the dielectric plate and a supporting part which is connected to the first surface and which is contiguous to the principal part to support the principal part. A ground plate is located in parallel with the dielectric plate with a space interval which left between the second surface and the ground plate.

4 Claims, 5 Drawing Sheets

MICROSTRIP TYPE ANTENNA HAVING SMALL SIZE AND CAPABLE OF CHANGING GAIN

BACKGROUND OF THE INVENTION

This invention relates to a microstrip type antenna which is used in a radio transceiver or a mobile telephone set.

A conventional microstrip antenna of the type described includes a dielectric plate having first and second surfaces which are parallel or opposite to each other. An emission or antenna element is formed on the first surface of the dielectric plate. A ground conductor is formed on the second surface of the dielectric plate. An additional or dummy element is located in parallel to the emission element with a space or gap left between the elements.

In the conventional microstrip antenna, a gain increases with an increase of a distance between the emission element and the ground conductor. Accordingly, it is desirable that the distance between the emission element and the ground conductor becomes long so as to obtain a large gain.

On the other hand, it is preferable that the dielectric plate becomes thin so as to miniaturize the microstrip antenna.

Therefore, a trade-off is inevitable between miniaturization of the microstrip antenna and a large gain. As a result, the gain is inevitably limited by the size of the microstrip antenna.

SUMMARY OF THE INVENTION

It is therefore an object of this invention to provide a microstrip type antenna which has a large gain in a small size or for a size.

It is another object of this invention to provide a microstrip type antenna which is capable of changing a gain.

Other objects of this invention will become clear as the description proceeds.

According to an aspect of this invention, a microstrip type antenna is used in a radio transceiver and comprises a dielectric plate which has first and second surfaces in parallel to each other. A plane antenna element has a principal part which is located in parallel to the dielectric plate and a supporting part which is connected to the first surface and which is contiguous to the principal part to support the principal part. A ground plate is located in parallel to the dielectric plate with a space interval left between the second surface and the ground plate. Interval adjusting means is coupled to the dielectric plate and moves the dielectric plate in relative to the ground plate to adjust the space interval.

DESCRIPTION OF THE PREFERRED EMBODIMENT

Figure 1:
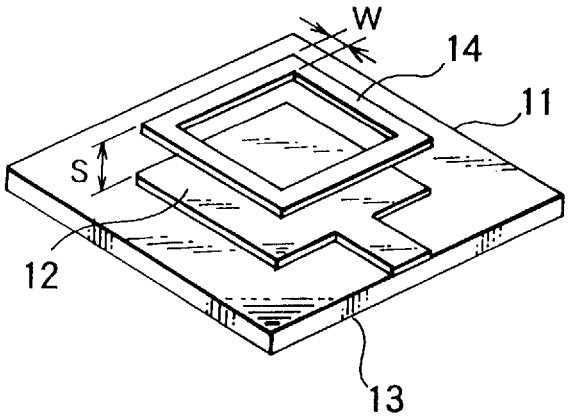
FIG. 1 PRIOR ART
FIG. 1 shows a conventional microstrip antenna.

Referring to FIG. 1, description will be at first directed to a conventional microstrip antenna for a better understanding of this invention.

The illustrated conventional microstrip antenna is substantially equivalent to that disclosed in Japanese Patent Prepublication No. 79602/1990.

The microstrip antenna has a dielectric plate 11 which has first and second surfaces which are opposite to each other and which are directed upwards and downwards of FIG. 1, respectively. An emission or antenna element 12 is formed on the first surface of the dielectric plate 11. A ground conductor 13 is formed on a second surface of the dielectric plate 11. An additional or a dummy element 14 is located in parallel to the the emission element 12 with a space S which is left between the additional element 14 and the emission element 12. The additional element 14 is fixed to the emission element 12 by small dielectric supports (not shown) which are located between the additional element 14 and the emission element 12. The additional element 14 serves to spread or widen an operating frequency band of the conventional microstrip antenna.

When the additional element 14 is structured by a square-shaped plate, the space S should be equal to several centimeters without any inside opening. On the other hand, when the additional element 14 is formed by a square-shaped loop as shown in FIG. 1, the space S can be reduced to ⅛–1/10 of the above-mentioned space S in the the square-shaped plate.

In the meanwhile, the conventional microstrip antenna has a gain which depends on a distance between the emission element 12 and the ground conductor 13. The distance is equal to a thickness of the dielectric plate 11. Accordingly, the gain is determined by the thickness of the dielectric plate 11. Because the thickness has an effect on a size of the microstrip antenna, the gain is limited by the size of the microstrip antenna. The conventional microstrip antenna is designed in consideration of a trade-off between the gain and the size.

Referring to FIGS. 2A and 2B through FIGS. 4A and 4B, description will be made about a microstrip type antenna according to a first embodiment of this invention.

Figure 2A:
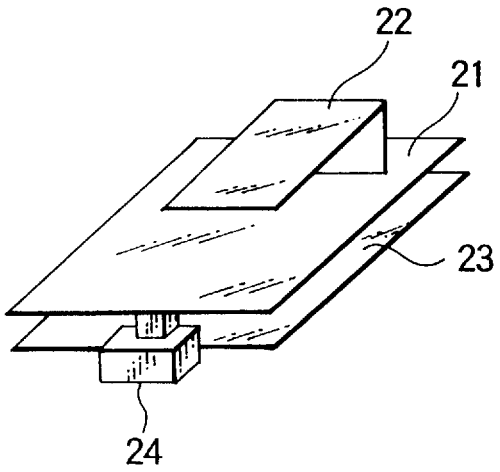
FIGS. 2A and 2B show a microstrip type antenna according to a first embodiment of this invention.
Figure 2B:
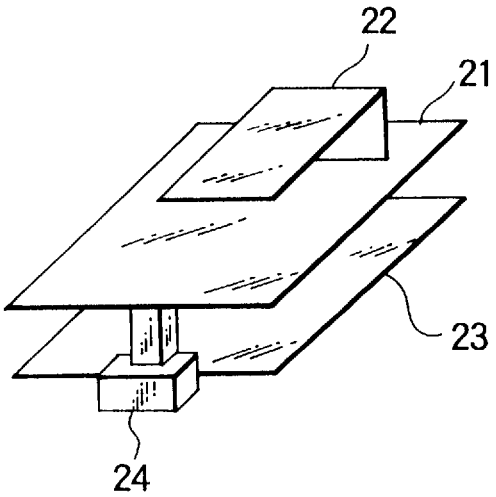

In FIGS. 2A and 2B, a microstrip type antenna comprises a dielectric or an insulation plate 21 which has first and second surfaces in parallel to each other. A plane antenna element 22 has a principal part and a supporting part which is contiguous to the principal part and extended to the plate 21. To this end, the plane antenna element 22 is bent at a right angle at the boundary line between the principal part and the supporting part. The supporting part is fixed to the first surface of the dielectric plate 21 so that the principal part is parallel to the first surface with a space which is left between the principal part and the first surface. The plane antenna element 22 realizes a necessary wide operating frequency band without a additional element. A ground plate 23 is located in parallel to the second surface of the dielectric plate 21 with a space interval which is left between the ground plate 23 and the second surface.

Each of push-button switches 24 (only one of them shown in FIGS. 2A and 2B) have fixed portion and movable portion. The movable portion is coupled to a fringe of the second surface of the dielectric plate 21. Each of the push-button switches 24 is selectively put into locked and unlocked states. In the locked state, the push-button switch 24 has a first height, as shown in FIG. 2A. When the push-button switch 24 is put in the locked state and the movable portion is pushed toward the fixed portion, the push-button switch 24 is changed into the unlocked state. In the unlocked state, the push-button switch 24 has a second height which is higher than the first height, as illustrated in FIG. 2B. When the push-button switch 24 is put or kept in the unlocked state and the movable portion is pushed toward the fixed portion, the push-button switch 24 is returned into the locked state. If the ground plate 23 and the fixed portion of the push-button switch 24 are fixed to a main part of a radio transceiver, the dielectric plate 21 moves up and down together with the movable portion of the push-button switch 24 each time when the push-button switch 24 is pushed down. Namely, the space interval between the dielectric plate 21 and the ground plate 23 is changed by depressing of the push-button switch 24. This means that a distance between the antenna element 22 and the ground plate 23 is changable by the state of the push-button switch 24.

In this structure, the gain in the unlocked state is bigger than that in the locked state. If the gain in the unlocked state is equal to the gain of the conventional microstrip antenna, a size of this microstrip type antenna in the locked state is smaller than that of the conventional microstrip antenna. If the gain in the locked state is equal to the gain of the conventional microstrip antenna, the gain of this microstrip type antenna in the unlocked state is larger than that of the conventional microstrip antenna. At any rate, the microstrip type antenna accomplishes a large gain for size or in a small size in the locked state. In practice, it is desirable that the distance between the antenna element 22 and the ground plate 23 is designed as small as possible in consideration of a minimum gain required for the antenna.

Figure 3:
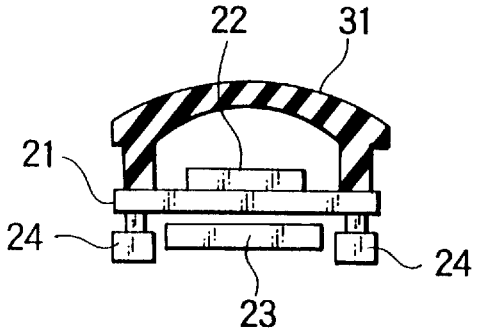
FIG. 3 shows a sectional view of the microstrip type antenna of FIG. 1 and a molded cover which is cover the microstrip type antenna.

In FIG. 3, the microstrip type antenna is combined with a molded cover 31. The molded cover 31 is fixed to the dielectric plate 21 to cover the antenna element 22.

Figure 4A:
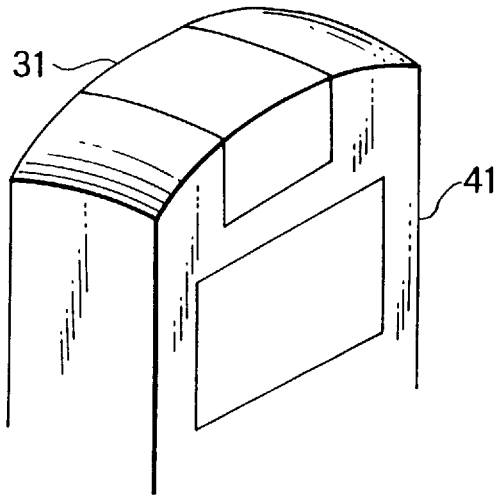
FIGS. 4A and 4B show a part of a radio transceiver which is combined with the microstrip type antenna of FIG. 1.
Figure 4B:
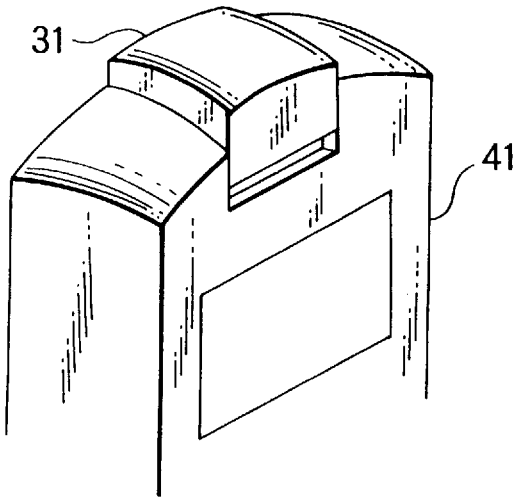

In FIGS. 4A and 4B, the microstrip type antenna with the molded cover 31 is incorporated into the main part 41 of the radio transceiver. The ground plate 23 and the fixed portion of the push-button switch 24 are fixed to the main part 41.

When the push-button 24 is kept in the locked state, the molded cover 31 forms a smooth surface together with the main part 41. On the other hand, when the push-button 24 is kept in the unlocked state, the molded cover 31 is projected from the main part 41.

Figure 5:
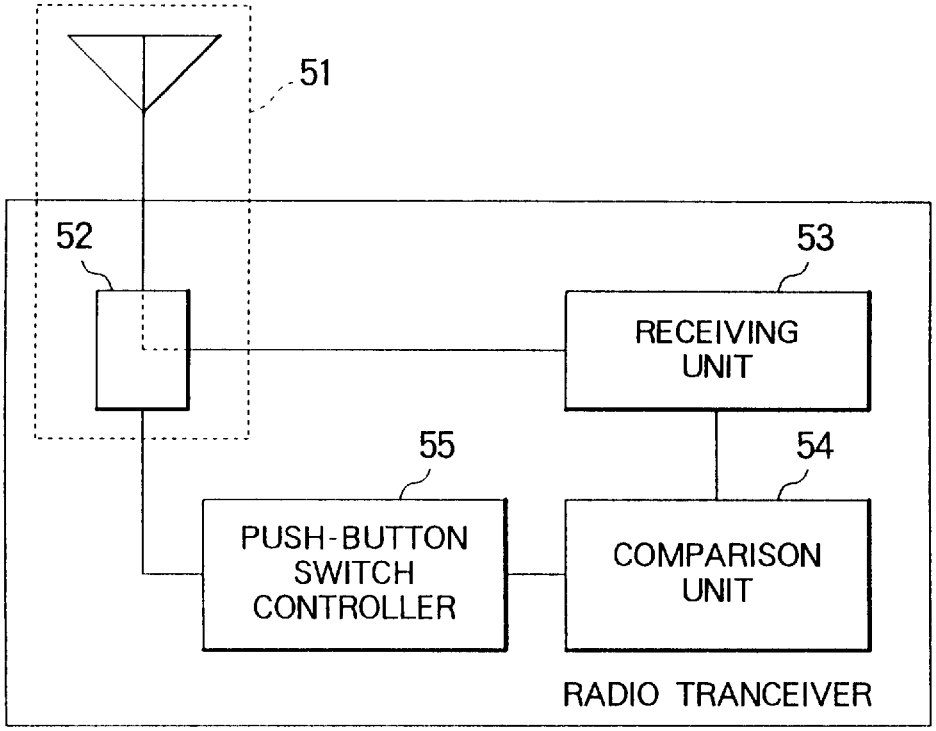
FIG. 5 shows a block diagram of a microstrip type antenna according to a second embodiment of this invention.

Referring to FIG. 5, description will be made about a microstrip type antenna according to a second embodiment of this invention.

In FIG. 5, a microstrip type antenna comprises an antenna unit 51 which is similar in structure to the microstrip type antenna according to the first embodiment except that a push-button switch 52 is included in the antenna unit 51. The antenna unit 51 receives a radio signal and produces a received signal. A receiving unit 53 is connected to the antenna unit 51 and detects an electric field strength of the radio signal from the received signal. A comparison unit 54 is connected to the receiving unit 53 and compares the electric field strength detected by the receiving unit 53 with a predetermined value to produce a comparison signal. A push-button switch controller 55 is connected to the comparison unit 54 and the push-button switch 52 to control the push-button switch 52 in response to the comparison signal. The push-button switch 52 is controlled by the push-button switch controller 55 and changes a state between a locked state and an unlocked state.

When the electric field strength is smaller than the predetermined value, the comparison unit 54 produces the comparison signal which is indicative of a change from the locked state to the unlocked state. The push-button switch controller 55 puts the push-button switch 52 into the unlocked state in response to the comparison signal. On the other hand, when the electric field strength is greater than the predetermined value, the comparison unit 54 produces the comparison signal which is representative of a change from the unlocked state into the locked state. In this case, the push-button switch controller 55 puts the push-button switch 52 in the locked state in response to the comparison signal.

While this invention has thus far been described in conjunction with a few embodiments thereof, it will be readily possible for those skilled in the art to put this invention into practice in various other manners. For example, other apparatuses may be used for changing the space interval between the dielectric plate 21 and the ground plate 23 in place of the push-button switches 24 and 52.

Moreover, the comparison unit 54 may produce the comparison signal and the push-button switch controller 55 may put the push-button switch 52 in the unlocked state in response to the comparison signal only when the electric field strength is smaller than the predetermined value. In this case, the comparison unit 54 and the push-button switch controller 55 can be simplified in structure because the change from unlocked state to locked state can be manually controlled.

What is claimed is:

1. A microstrip antenna used in a radio, transceiver, said microstrip antenna comprising;

a dielectric plate having first and second surfaces which are parallel to each other;

a planar antenna element having a principal part located in parallel with said dielectric plate and a supporting part connected to said first surface and contiguous to said principal part to support said principal part;

a ground plate located in parallel with said dielectric plate with a space interval left between said second surface and said ground plate; and interval adjusting means coupled to said dielectric plate for moving said dielectric plate relative to said ground plate to adjust said space interval.

2. A microstrip antenna as claimed in claim 1, wherein said planar antenna element is a metal plate which is bent at right angles on a boundary line between said principal part and said supporting part.

3. A microstrip antenna as claimed in claim 1, wherein said interval adjusting means is a push-button switch which has a first state of a first height and a second state of a second height being taller than said first height.

4. A microstrip antenna as claimed in claim 1, said microstrip antenna receiving a radio signal and further comprising;

electric field strength detecting means connected to said planar antenna element for detecting an electric field strength of said radio signal to produce a detecting signal, and interval controlling means connected to said electric field strength detecting means and said interval adjusting means for controlling said interval adjusting means in response to said detecting signal to adjust said space interval.

* * * * *